US010576333B2

(12) United States Patent
Chiang

(10) Patent No.: US 10,576,333 B2
(45) Date of Patent: Mar. 3, 2020

(54) SWIMMING GOGGLE STRUCTURE

(71) Applicant: Global Esprit Inc., New Taipei (TW)

(72) Inventor: Herman Chiang, New Taipei (TW)

( * ) Notice: Subject to any disclaimer, the term of this patent is extended or adjusted under 35 U.S.C. 154(b) by 266 days.

(21) Appl. No.: 15/680,234

(22) Filed: Aug. 18, 2017

(65) Prior Publication Data

US 2019/0015705 A1 Jan. 17, 2019

(30) Foreign Application Priority Data

Jul. 14, 2017 (TW) ..... 106210447 A

(51) Int. Cl.
*A63B 33/00* (2006.01)
*A63B 1/00* (2006.01)

(52) U.S. Cl.
CPC ..... *A63B 33/002* (2013.01); *A63B 1/00* (2013.01); *A63B 2033/004* (2013.01)

(58) Field of Classification Search
CPC .... A63B 33/002; A63B 2033/004; A63B 1/00
USPC ..... 2/440, 442–444
See application file for complete search history.

(56) References Cited

U.S. PATENT DOCUMENTS 5,596,771 A * 1/1997 Hsu ..... A63B 33/002 2/428
6,070,272 A * 6/2000 Chiang ..... A63B 33/002 2/428
6,112,334 A * 9/2000 Chiang ..... A63B 33/002 2/428
7,647,650 B2 * 1/2010 Chiang ..... A63B 33/002 2/426
2009/0276942 A1 * 11/2009 Chiang ..... A63B 33/002 2/452
2011/0004981 A1 * 1/2011 Chiang ..... A63B 33/002 2/446
2019/0070464 A1 * 3/2019 Chiang ..... A63B 33/002

* cited by examiner

*Primary Examiner* — Gloria M Hale

(57) ABSTRACT

A swimming goggle structure comprises a left frame, a right frame, a connection element, two protection pads, and two packing frames. Each of the two protection pads has a circular body and the circular body is arranged with a face contact circumference, characterized in that the two packing frames can assemble the left frame, the right frame and two protection pads as a firm structure, and that the left(right) frame has an inclined guide surface for convenience in disassembly of the packing frames from the left(right) frame, and that a connection base of the left(right) frame has a connection hole of trumpet-like shape, so that two connection pillars of the connection element is designed with incorporation of a truncated guide surface which allows the connection element to be assembled and disassembled in a convenience way. Besides, such a structural also provides the wearer with more component options during assembly.

11 Claims, 6 Drawing Sheets

SWIMMING GOGGLE STRUCTURE

BACKGROUND OF THE INVENTION

1. Field of the Invention

The present invention relates generally to a pair of swimming goggles and in particular to a swimming goggle structure which provides the wearer with more component options during assembly, such as options in colors of frames and myopic degrees of lenses, as a novel customized design.

2. Related Art

Conventionally, a swimming goggle structure comprises frames, lenses, protection pads and a head strap. The conventional swimming goggle structure design is made left-and-right symmetrical for comfortable engagement with the wearer's skin as well as for water proof. The symmetry design provides both frames with same structure type, same color and same lens specification. However, with mix and match style being popular nowadays, sales mode in the market has gradually changed. The swimming goggle market is no exception. The swimming pool, as known, is either indoor or outdoor. The outdoor swimming pool has brighter light especially while the sun is shining. Swimmers would rather take swimming goggles of which lenses provide a sun-shading effect. This kind of lenses is usually made with colors against the sun's radiation. For the indoor swimming pool, swimmers commonly take swimming goggles whose lenses are transparent and not colorful. For consumers, it is rarely to prepare two pairs of swimming goggles at the same time for both indoor and outdoor uses due to inconvenience to carry. In addition, if a consumer has myopia, the conventional swimming goggles fail to provide the left and right eyes with lenses with different myopic degrees because the left and right lenses are made same in the symmetry design. Furthermore, younger swimmers tend to dress in innovation and variety of way, so the monotonous goggle design appears drab to them and may not meet their needs. In addition to a change for structural design, the match of color and pattern may be a consideration for a visual effect. Therefore, the conventional swimming goggles can be improved if they are provided with a detachably assembled structure in which the frames or lenses are allowed to be replaced individually, so as to provide wearers with more choice matches from various assembly combinations.

SUMMARY OF THE INVENTION

It is an object of the present invention to provide a swimming goggle structure, which incorporates features that benefit convenient disassembly and firm assembly, which provides the wearer with more component options during assembly, such as options in colors of frames and myopic degrees of lenses, as a customized design.

To achieve the object, a swimming goggle structure in accordance with the present invention comprises: a left frame and a right frame, respectively having a circumference surface, the circumference surface being integrally formed with a lens and a connection base, the connection base being disposed with a connection hole; a connection element, interposed between the left frame and the right frame, the connection element being integrally disposed with two connection pillars, each of the two connection pillars being engaged with the connection hole of the connection base; two protection pads, respectively assembled with the left frame and the right frame, each of the two protection pads having a circular body, a side of the circular body being arranged with a face contact circumference, and two packing frames, respectively assembled with the circular grooves of the left frame and the right frame, each of the packing frame having a rim, a hole and a head strap base, characterized in that:

the connection hole of the connection base of each of the left frame and the right frame has a trumpet-like shape having a wide upper end and a narrow lower end, a fastening notch is disposed inside the connection hole, a locating flange is disposed a side opposite to the lens, a circular groove abuts the locating flange;

The two connection pillars of the connection element are respectively disposed with a barb, the barb has a hook, the hook is engaged with the fastening notch of the connection hole, further, each of the two connection pillars has a truncated guide surface at a side opposite to the hook;

a slot is disposed inside the circular body and is engaged with the locating flange, a circular lip being disposed at a side opposite to the face contact circumference, the circular lip is engaged with the circular groove;

the rim is forced against the circular lip and is disposed with an extension surface, an internal diameter of the hole is slightly smaller than a maximum external diameter of the circumference surface of each of the left frame and the right frame, the head strap base is disposed on the extension surface of the rim.

Accordingly, for the assembly of the pair of swimming goggles, the slot of the protection pad is engaged with the locating flange of the left(right) frame, then the rim of the packing frame is abutted against the circular lip of the protection pad from a side of the rim adjacent to the connection base, along upper and lower edges of the circular lip. The packing frame makes the hole thereof cross over an edge of the circumference surface of the left(right) frame defined as the maximum external diameter, and interferes with the circular groove corresponding to the maximum external diameter of the circumference surface of the left (right) frame, while the packing frame is guided along the inclined guide surface, which allows the packing frame to be abutted against the circular lip in a compression-fitting manner, and thereby the circular lip is firmly fastened on the circular groove. In this manner, the left (right) frame, the protection pad and the packing frame are assembled as a firm structure. Therefore, after the left frame and the right frame are assembled individually, the connection pillar of the connection element is then engaged with the connection hole, while the hook of the barb of the connection pillar is engaged with the fastening notch inside the connection hole, so as to firmly connect the left frame and the right frame.

For the disassembly of the pair of swimming goggles, the connection element is disassembled first. The disassembly of the connection element includes rotating the connection element toward the hook along the truncated guide surface located opposite to the hook of the barb, in order to make the interference portion of the connection pillar disengaged with the inner wall of the connection hole, so as to disassemble the connection element from the connection hole of the left (right) frame. Next, the disassembly of the left frame, the right frame and the protection pads includes rotating the extension surface of the packing frame of the left(right) frame toward an outer side of the left(right) frame for removal of structural interference of the circular groove, and then making the rim of the packing frame out of the interference of the circular groove.

Accordingly, the inclined guide surface is formed at an inner edge of the circumference surface of the left(right) frame close to the wearer's outer eye corner, so when the packing frame is taken out along the inclined guide surface during disassembly of the swimming goggle structure, a structural interference of the circular groove can be removed.

Accordingly, a first alignment device is disposed between the protection pad and each of the left frame and the right frame, and a second alignment device is disposed between the packing frame and the protection pad, the first alignment device comprises a first recess and a first protuberance, the first recess is disposed on the locating flange of each of the left frame and the right frame, the first protuberance is disposed inside the slot of the protection pad, corresponding to the first recess, and when each of the left frame and the right frame is assembled with the protection pad, the first recess of each of the left frame and the right frame is engaged with the first protuberance for localization, the second alignment device comprises a second recess and a second protuberance, the second recess is disposed on an inner edge of the hole of the packing frame, the second protuberance is disposed on the circular lip of the protection pad, corresponding to the first protuberance, and when the packing frame is assembled with the protection pad, the second recess of the packing frame is engaged with the second protuberance for localization, so as to provide an accurately positioned assembly of the packing frame, the protection pad and each of the left frame and the right frame without any location deviation.

Accordingly, the circular body of the protection pad is disposed with a buffer device which provides a support and returning force against a structural deformation under external impact and provides an absorption of a compression-fitting force under pressure.

Accordingly, the face contact circumference of the protection pad has a wavy shape, that is, the protection pad is designed corresponding to the wearer's eye socket contour, so as to provide a comfortable contact engagement with the wearer's eye socket.

DESCRIPTION OF THE INVENTION

Figure 1:
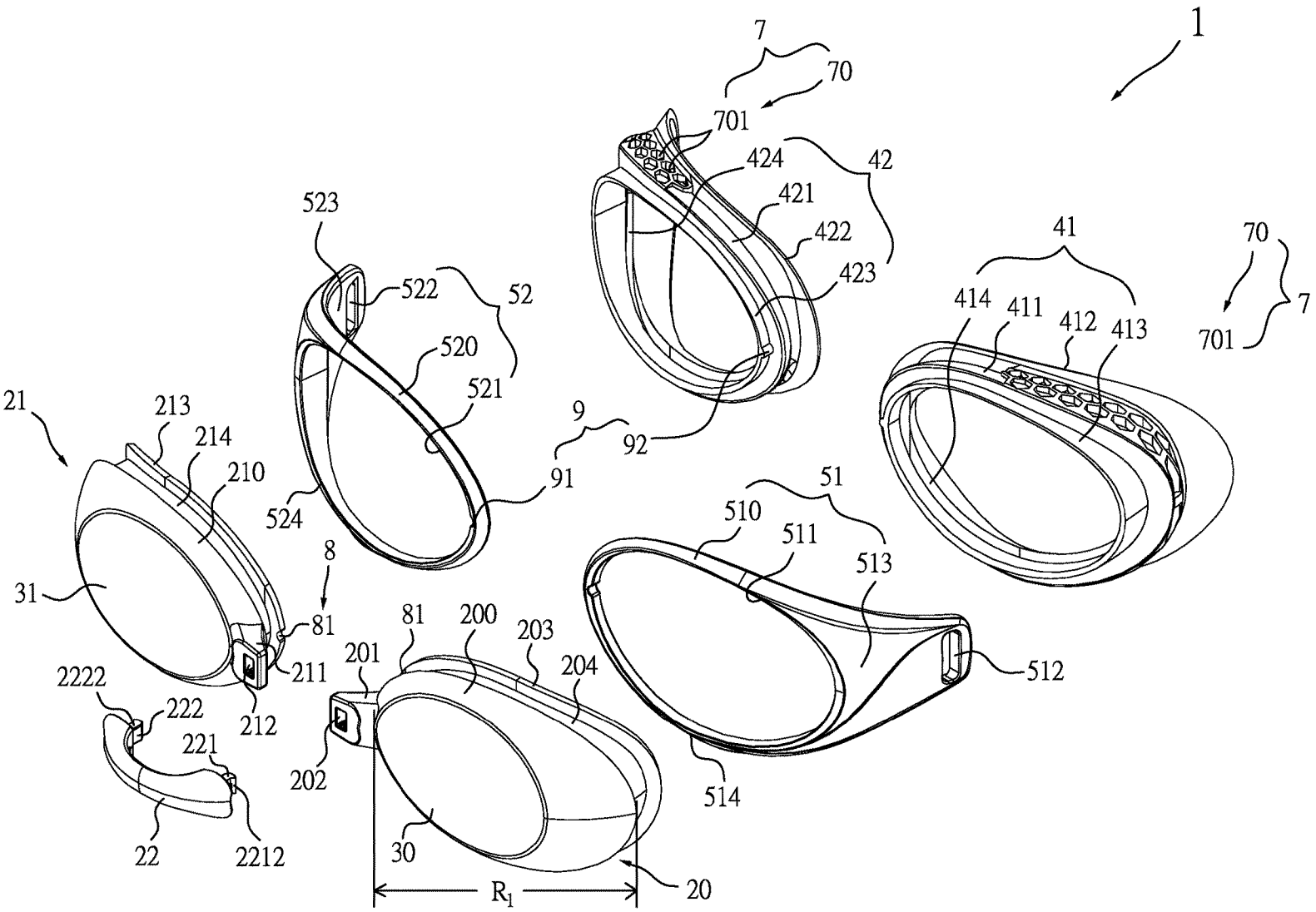
FIG. 1 is an exploded perspective view of the swimming goggles in accordance with the present invention.
Figure 2:
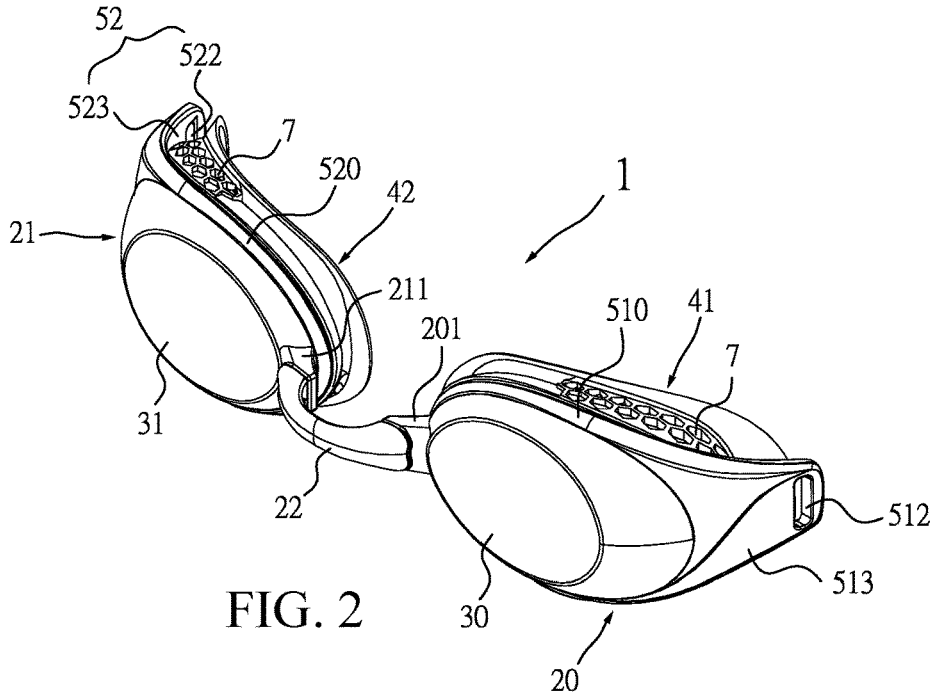
FIG. 2 is an assembled perspective view of the swimming goggles in accordance with the present invention.
Figure 6:
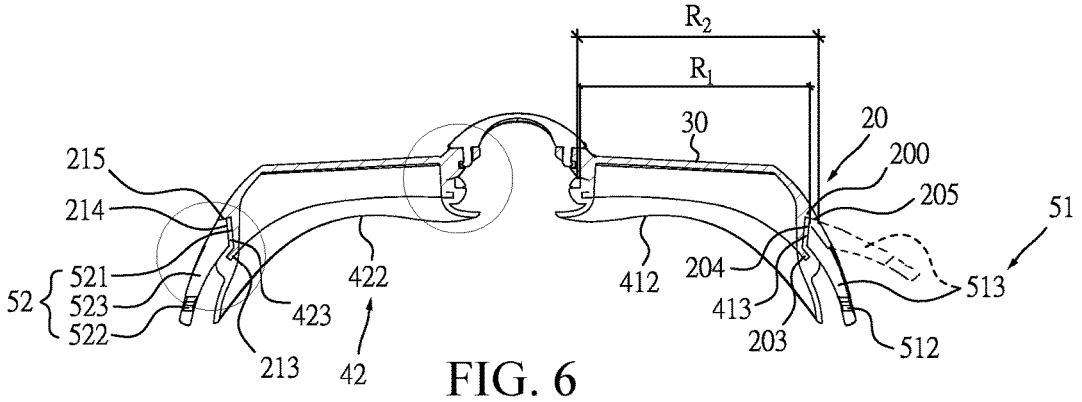
FIG. 6 is a cross-sectional view taken along line 6-6 of FIG. 3.
Figure 6B:
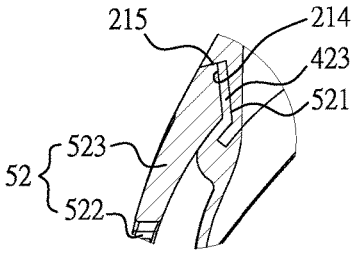
FIGS. 6A and 6B are cross-sectional partially enlarged views taken along line 6-6 of FIG. 3.
Figure 6A:
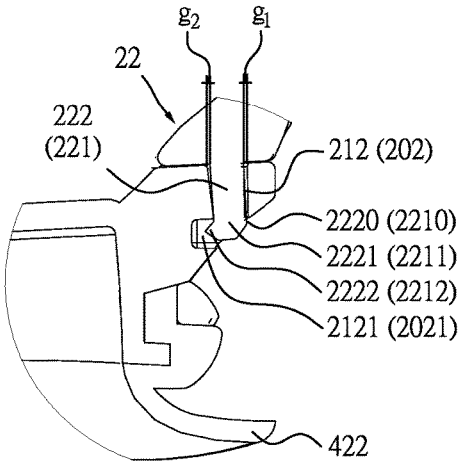
Figure 6C:
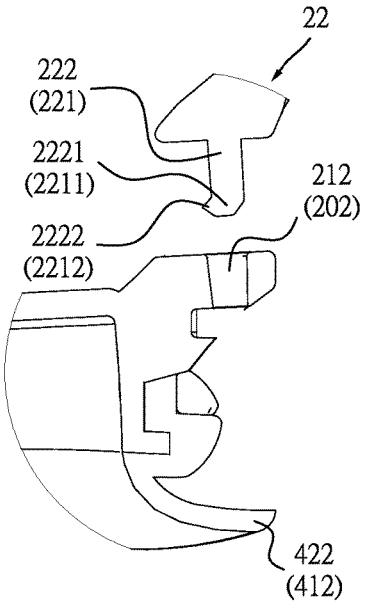
FIGS. 6C, 6D and 6E are schematic views showing states before and after the connection element is assembled, and a state that the connection element is being disengaged.

Referring to FIG. 1 and FIG. 2, a pair of swimming goggles 1 comprises a left frame 20, a right frame 21, a connection element 22, lenses 30,31, protection pads 41,42, packing frames 51,52, and head strap bases 512,522. The left frame 20 and the right frame 21 may be made of polycarbonate resin. Each of the left frame 20 and the right frame 21 is integrally formed with the lens 30(31) and has a circumference surface 200(210) around the lens 30(31). The circumference surface 200(210) is integrally formed with a connection base 201(211) which is integrally extended from the left (right) frame 20(21). The connection base 201(211) has a connection hole 202(212) used to assemble the connection element 22. The connection hole 202(212) has a trumpet-like shape having a wide upper end and a narrow lower end. A fastening notch 2021(2121) is disposed inside the connection hole 202(212) as shown in FIG. 6A. A locating flange 203(213) is disposed on the left (right) frame 20(21) at a side opposite to the lens 30(31). A circular groove 204(214) used to assemble the protection pad 41(42) is disposed on the left (right) frame 20(21) and abuts the locating flange 203(213). An inner edge of the circumference surface 200(210) is formed with an inclined guide surface 215(205) as shown in FIG. 6, FIG. 6B, FIG. 7A, FIG. 7B. The inclined guide surface 215(205) is used to provide a guidance for the disassembly of the packing frame 52(51), so as to provide an easy disassembly way.

Figure 6D:
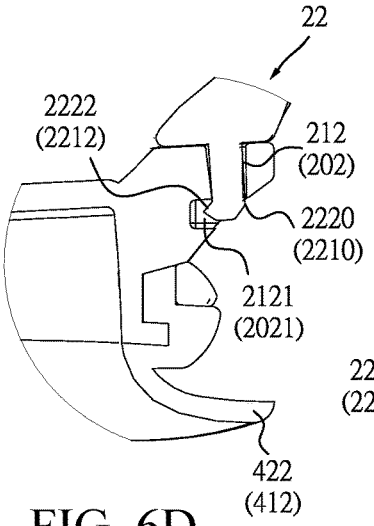
Figure 6E:
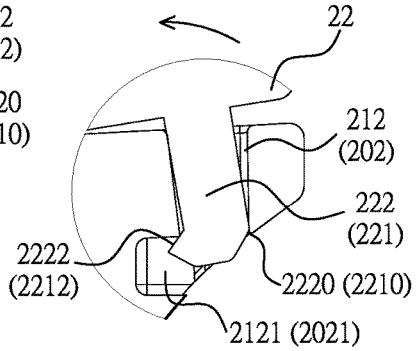

The connection element 22, with reference to FIG. 6A, FIG. 6C, FIG. 6D, FIG. 6E, is interposed between the left frame 20 and the right frame 21. The connection element 22 is integrally disposed with connection pillars 221,222 which are extended at an angle from both ends of the connection element 22 toward the connection base 201(211) and are utilized to engage with the connection holes 202,212 of the trumpet-like shape. In this structure, gaps g1,g2 (FIG. 6A) are therefore produced at the upper end of the connection hole 202(212) after the connection pillar 221(222) is engaged with the connection hole 202(212). By advantage of retaining the gaps g1,g2, more space is provided to facilitate the assembly and disassembly between the connection base 201(211) and the connection element 22. To avoid the undesirable detachment of the connection pillar 221(222) from the connection hole 202(212), the connection pillar 221(222) is further disposed with a barb 2211(2221), and the barb 2211(2221) has a hook 2212(2222) used to engaged with the fastening notch 2021(2121) of the connection hole 202(212), so that the left frame 20 and the right frame 21 are assembled as a firm structure without looseness. Further, with reference to FIG. 6C and FIG. 6D, it is shown that the connection hole 202(212) of the trumpet-like shape having the wide upper end and the narrow lower end is able to receive the connection pillar 221(222) in a convenient way, with the hook 2212(2222) engaged with the fastening notch 2021(2121). During disassembly of the connection element 22, the gap g2 retained between the connection hole 202(212) and the connection pillar 221(222) provides the connection element 22 with sufficient space to make a rotation toward the hook 2212(2222), which allows an interference portion 2210(2220) of the connection pillar 221(222) to be disengaged with an inside wall of the connection hole 202(212), as shown in FIG. 6D. In addition, the connection pillar 221(222) has a truncated guide surface 2213(2223) at a side opposite to the hook 2212(2222). After the interference portion 2210(2220) is disengaged with the inner wall of the connection hole 202(212), the truncated guide surface 2213(2223) guides the connection pillar 221 (222) along the inner wall of the connection hole 202(212) to pull the hook 2212(2222) out of the fastening notch 2021(2121), so as to achieve the disassembly of the connection element 22.

Figure 4:
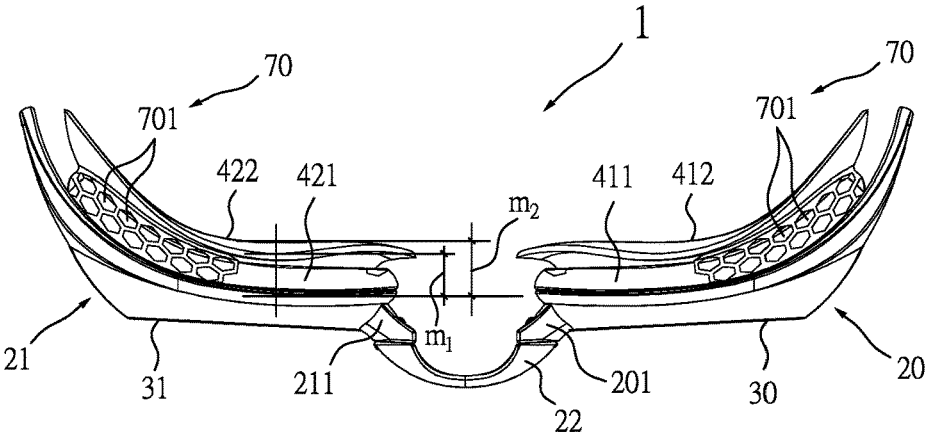
Figure 5:
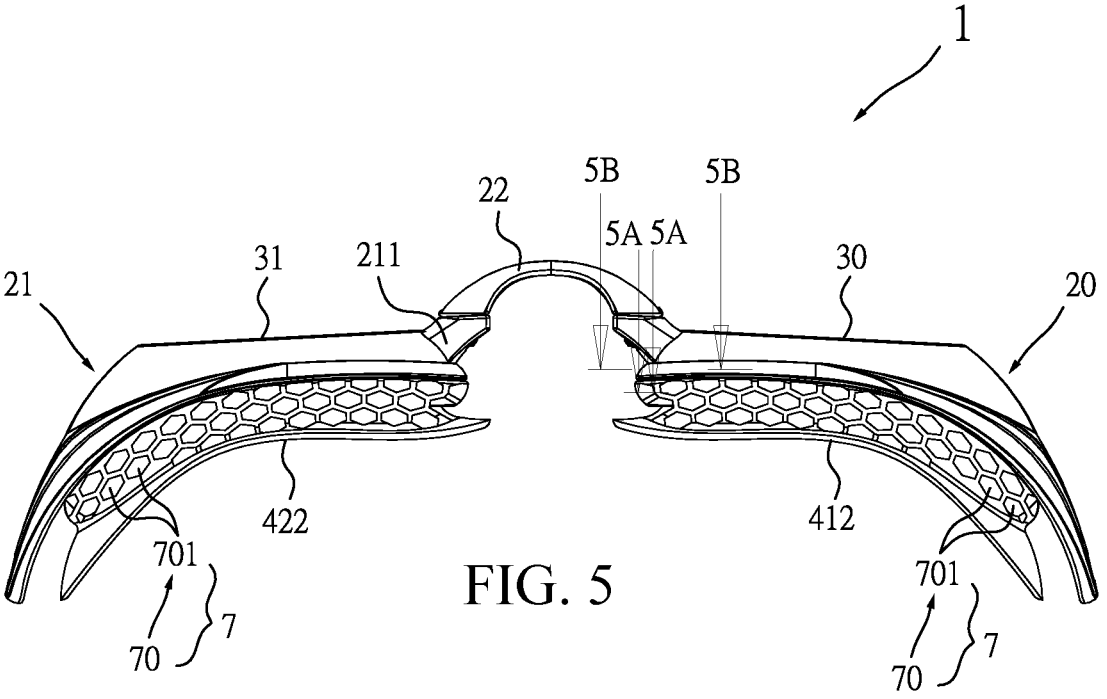

The protection pads 41,42 are connected with the left frame 20 and the right frame 21. Each of the protection pads 41,42 has a circular body 411(421). A side of the circular body 411(421) is arranged with a face contact circumference 412(422) in a wavy shape, shown in FIG. 4 and FIG. 5. The circular body 411(421) has a width m1 with respect to a portion of the eye socket near the eyebrow (FIG. 4) and has a width m2 with respect to a portion of the eye socket near the zygomatic bone (FIG. 5), wherein the width m1 is less than the width m2. Therefore, the protection pad 41(42) is designed corresponding to the eye socket contour consisting of a raised top and a concave bottom, so as to provide a comfortable contact engagement with the eye socket of the wearer. Further, the protection pad 41(42) is disposed with a circular lip 413(423) at a side opposite to the face contact circumference 412(422). The circular lip 413(423) is engaged with the circular groove 204(214) of the left (right) frame 20(21). A slot 414(424) is disposed inside the circular body 411(421) and is used to be engaged with the locating flange 203(213) of the left (right) frame 20(21). Further, the circular body 411(421) of the protection pad 41(42) is disposed with a buffer device 7. The buffer device 7 comprises a plurality of compartments 70. The plurality of compartments 70 having openings 701 are extended in an interlaced arrangement. Each of the openings 701 has a geometric shape such as honeycomb, ellipse and rectangle, so as to provide a support and returning force against a structural deformation under external impact and thus to absorb the compression-fitting force under pressure. It is noted that the plurality of compartments 70 may be located at a first part of the circular body 411(421) with respect to a portion of the eye socket between the eyebrow and the outer eye corner (FIG. 4), as well as at a second part of the circular body 411(421) with respect to a portion of the eye socket near the zygomatic bone (FIG. 5).

Figure 3:
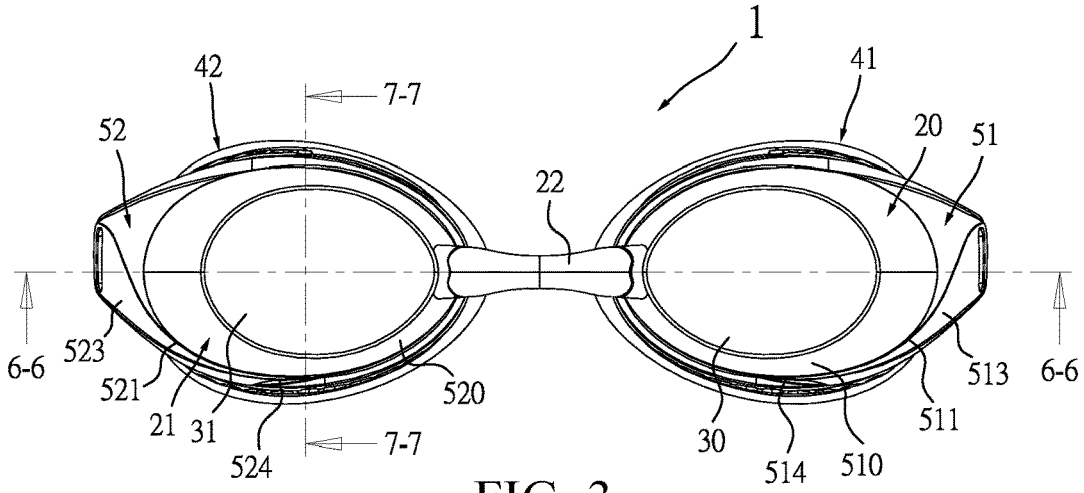
FIGS. 3-5 are a front view, a top view and a bottom view of FIG. 2, respectively.
Figure 7:
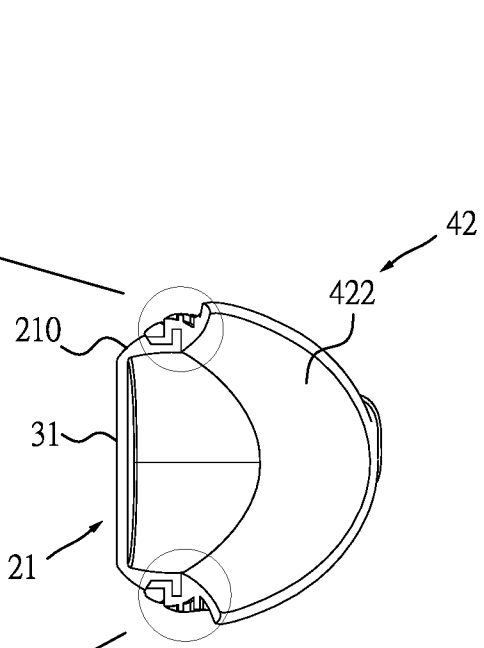
FIG. 7 is a cross-sectional view taken along line 7-7 of FIG. 3.
Figure 7A:
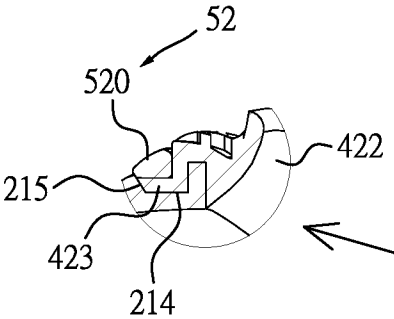
FIGS. 7A and 7B are cross-sectional partially enlarged views taken along line 7-7 of FIG. 3.
Figure 7B:
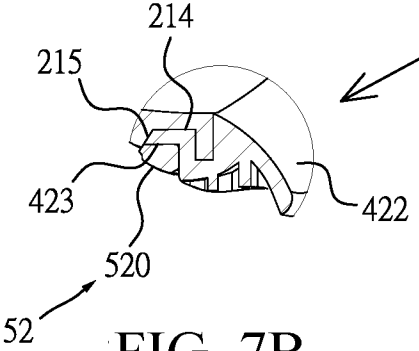

The packing frames 51,52 are assembled with the circular grooves 204,214 of the left frame 20 and the right frame 21. Each of the packing frame 51,52 has a rim 510(520), a hole 511(521) and the head strap base 512(522). The rim 510 (520) is forced against the circular lip 413(423) of the protection pad 41(42), while an internal diameter R2 of the hole 511(521) is made slightly smaller than a maximum external diameter R1 of the circumference surface 200(210) of the left(right) frame 20(21)(as shown in FIG. 6), so that the rim 510(520) is firmly fastened on the circular lip 413(423) of the protection pad 41(42) in a compression-fitting manner. With reference to FIG. 6, FIG. 7A, FIG. 7B, it is noted that when the packing frame 51(52) is disassembled, because there is a stronger structural interference between the circular lip 413(423) and a part of the packing frame 51(52) with respect to a portion of the outer eye corner, the packing frame 51(52) must make the hole 511 (521) thereof cross over an edge of the circumference surface 200(210) of the left(right) frame 20(21) defined as the maximum external diameter R1, while the packing frame 51(52) is guided along the inclined guide surface 215(205), shown as dotted lines in FIG. 6D, for removal of structural interference. Once the circular lip 413(423) and the packing frame 51(52) are mutually out of the structural interference, another structural interference between upper and lower parts of the left(right) frame 20(21)(as shown in FIG. 7A and FIG. 7B) and the packing frame 51(52) is thereby reduced, so as to be beneficial for convenience of the disassembly of the packing frame 51(52). Further, a drain channel 514(524) is disposed on a portion of the rim 510(520) of the packing frame 51(52) with respect to the wearer's cheek, i.e. when the swimming goggles are put on, it is right below the eyeball, as shown in FIG. 1 and FIG. 3, so as to improve drainage without water retention after the wearer leaves the water.

Further, the head strap base 512(522) is disposed on an extension surface 513(523) of the rim 510(520). The head strap base 512(522) provides an oblong hole for the head strap to get through.

Figure 5A:
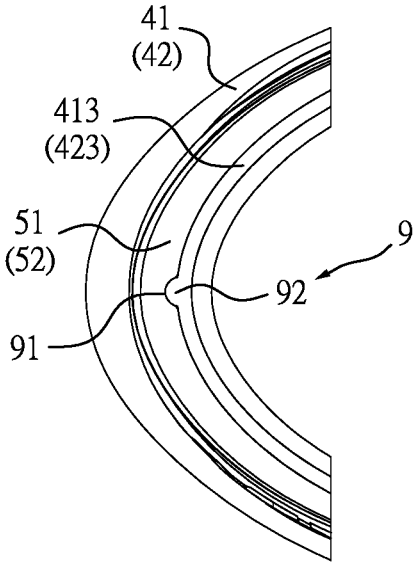
FIG. 5A is a cross-sectional view taken along line 5A-5A of FIG. 5.
Figure 5B:
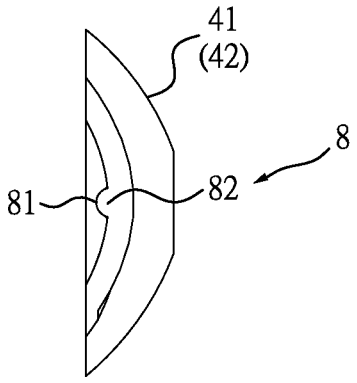
FIG. 5B is a cross-sectional view taken along line 5B-5B of FIG. 5.

Further, a first alignment device 8 is disposed between the left(right) frame 20(21) and the protection pad 41(42), and a second alignment device 9 is disposed between the packing frame 51(52) and the protection pad 41(42). The first alignment device 8 comprises a first recess 81 and a first protuberance 82. The first recess 81 is disposed on the locating flange 203(213) of the left(right) frame 20(21). The first protuberance 82 is disposed inside the slot 414(424) of the protection pad 41(42), corresponding to the first recess 81. With reference to FIG. 1, in view of FIG. 5, FIG. 5A, and FIG. 5B, when the left(right) frame 20(21) is assembled with the protection pad 41(42), the first recess 81 of the left(right) frame 20(21) is engaged with the first protuberance 82 for localization. The second alignment device 9 comprises a second recess 91 and a second protuberance 92. The second recess 91 is disposed on an inner edge of the hole 511(521) of the packing frame 51(52). The second protuberance 92 is disposed on the circular lip 413(423) of the protection pad 41(42), corresponding to the first protuberance 82. When the packing frame 51(52) is assembled with the protection pad 41(42), the second recess 91 of the packing frame 51(52) is engaged with the second protuberance 92 for localization. Therefore, the first alignment device 8 and the second alignment device 9 provide an accurately positioned assembly of the left(right) frame 20(21), the packing frame 51(52) and the protection pad 41(42) without any location deviation.

Figure 8C:
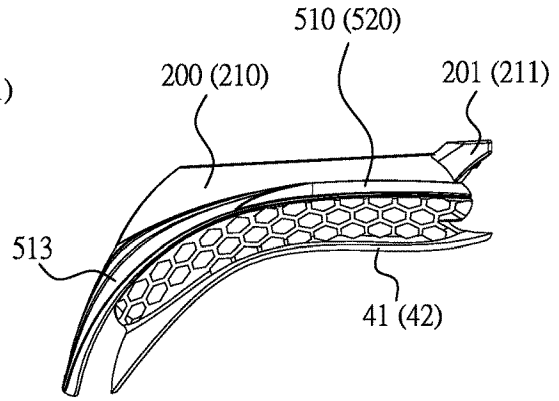
FIGS. 8A, 8B and 8C are assembled schematic views of the swimming goggles in accordance with the present invention.
Figure 8B:
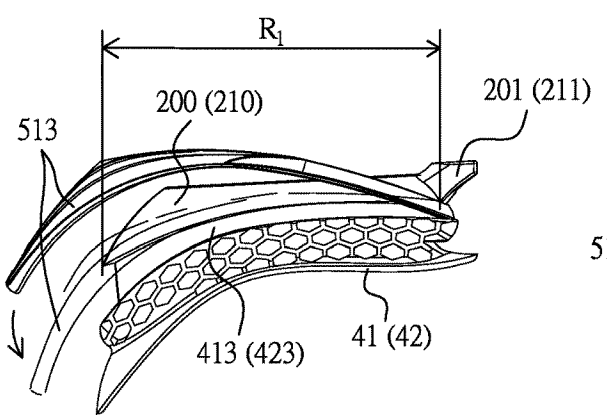
Figure 8A:
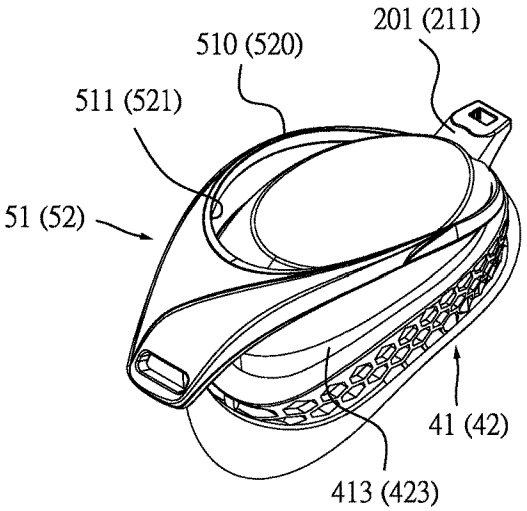

As to the assembly and disassembly of the pair of swimming goggles 1 in accordance with the present invention, first for the assembly of the pair of swimming goggles 1, the left frame 20 and the right frame 21 is assembled individually, and the connection element 22 is then used to connect the assembled left frame 20 and right frame 21 so the assembly of the pair of swimming goggles 1 is completed. In details, with reference to FIG. 1, FIG. 8A, FIG. 8B, FIG. 8C in view of FIG. 3, FIG. 5A, FIG. 5B, FIG. 6, FIG. 6A, FIG. 6B, the slot 414(424) of the protection pad 41(42) is engaged with the locating flange 203(213) of the left(right) frame 20(21), then the rim 510(520) of the packing frame 51(52) is abutted against the circular lip 413(423) of the protection pad 41(42) (FIG. 8A) from a side of the rim 510(520) adjacent to the connection base 201(211), along upper and lower edges of the circular lip 413(423), shown as dotted lines in FIG. 8B. The packing frame 51(52) makes the hole 511(521) thereof cross over an edge of the circumference surface 200(210) of the left(right) frame 20(21) defined as the maximum external diameter R1, and interferes with the circular groove 204(214) corresponding to the maximum external diameter R1 of the circumference surface 200(210) of the left (right) frame 20(21), shown in FIG. 6 and FIG. 8, while the packing frame 51(52) is guided along the inclined guide surface 215(205) shown as dotted lines in FIG. 6D, which allows the packing frame 51(52) to be abutted against the circular lip 413(423) in a compression-fitting manner, and thereby the circular lip 413(423) is firmly fastened on the circular groove 204(214). In this manner, the left (right) frame 20(21), the protection pad 41(42) and the packing frame 51(52) are assembled as a firm structure. Therefore, after the left frame 20 and the right frame 21 are assembled individually, the connection pillar 221(222) of the connection element 22 is then engaged with the connection hole 202(212), while the hook 2212(2222) of the barb 2211(2221) of the connection pillar 221(222) is engaged with the fastening notch 2021(2121) inside the connection hole 202(212)(FIG. 6), so as to firmly connect the left frame 20 and the right frame 21.

For the disassembly of the pair of swimming goggles 1, the connection element 22 is disassembled first. The disassembly of the connection element 22 includes rotating the connection element 22 toward the hook 2212(2222) along the truncated guide surface 2213(2223) located opposite to the hook 2212(2222) of the barb 2211(2221), in order to make the interference portion 2210(2220) of the connection pillar 221(222) disengaged with the inner wall of the connection hole 202(212)(FIG. 6D), so as to disassemble the connection element 22 from the connection hole 202(212) of the left (right) frame 20(21). Next, the disassembly of the left frame 20, the right frame 21 and the protection pads 41,42 includes rotating the extension surface 513(523) of the packing frame 51(52) of the left(right) frame 20(21) toward an outer side of the left(right) frame 20(21) (shown as dotted lines in FIG. 6D) for removal of structural interference of the circular groove 204(214), and then making the rim 510(520) of the packing frame 51(52) out of the interference of the circular groove 204(214). Therefore, the wearer can have several component options in assembly, such as in use of different colors for the left frame 20 and the right frame 21 and/or different myopic degrees for the two lenses.

In sum, when the pair of swimming goggles is assembled, the circular lip 413(423) of the protection pad 41(42) is firmly fastened on the circular groove 204(214) of the left (right) frame 20(21) by the packing frame 51(52) in a compression-fitting manner. When the pair of swimming goggles is disassembled, the packing frame 51(52) is separated from the circular groove 204(214) along the inclined guide surface 205(215) of the left (right) frame 20(21) as being out of the structural interference of the circular groove 204(214), so as to achieve convenient assembly and disassembly of the pair of swimming goggles. In addition to providing the options in colors and myopic degrees in assembly, the pair of swimming goggles also provides protection pad 41(42) having the plurality of compartments 70 with a shape fitting to the wearer's eye socket contour, which provides a preferable facial protection as well as a comfortable engagement in wearing.

It is understood that the invention may be embodied in other forms within the scope of the claims. Thus the present examples and embodiments are to be considered in all respects as illustrative, and not restrictive, of the invention defined by the claims.

What is claimed is:

1. A swimming goggle structure, comprising:

a left frame and a right frame, each respectively having a circumference surface, a fastening notch, a locating flange and a circular groove, the circumference surface being integrally formed with a lens and a connection base, the connection base being disposed with a connection hole of a trumpet-like shape having a wide upper end and a narrow lower end, the fastening notch being disposed inside the connection hole, the locating flange being disposed a side opposite to the lens, the circular groove abutting the locating flange;

a connection element, interposed between the left frame and the right frame, the connection element being integrally disposed with two connection pillars, each of the two connection pillars being engaged with the connection hole of the connection base and being disposed with a barb, the barb having a hook, the hook being engaged with the fastening notch of the connection hole, further, each of the two connection pillars having a truncated guide surface at a side opposite to the hook;

two protection pads, each respectively assembled with the left frame and the right frame, each of the two protection pads having a circular body, a circular lip and a slot, a side of the circular body being arranged with a face contact circumference, the circular lip being disposed at a side opposite to the face contact circumference, the circular lip being engaged with the circular groove, the slot being disposed inside the circular body and being engaged with the locating flange; and two packing frames, each respectively assembled with the circular grooves of the left frame and the right frame, each of the packing frame having a rim, a hole and a head strap base, the rim being forced against the circular lip and being disposed with an extension surface, an internal diameter of the hole being slightly smaller than a maximum external diameter of the circumference surface of each of the left frame and the right frame, and the head strap base being disposed on the extension surface of the rim.

2. The swimming goggle structure of claim 1, wherein an inner edge of the circumference surface is formed with an inclined guide surface, so that when each of the two packing frames is taken out along the inclined guide surface during disassembly of the swimming goggle structure, a structural interference that causes by contact with each of the two packing frames and acts on the circular groove is removed.

3. The swimming goggle structure of claim 1, wherein a first alignment device is disposed between the protection pad and each of the left frame and the right frame, and a second alignment device is disposed between the packing frame and the protection pad, the first alignment device comprising a first recess and a first protuberance, the first recess being disposed on the locating flange of each of the left frame and the right frame, the first protuberance being disposed inside the slot of the protection pad, corresponding to the first recess, and when each of the left frame and the right frame is assembled with the protection pad, the first recess of each of the left frame and the right frame is engaged with the first protuberance for localization, the second alignment device comprising a second recess and a second protuberance, the second recess being disposed on an inner edge of the hole of the packing frame, the second protuberance being disposed on the circular lip of the protection pad, corresponding to the first protuberance, and when the packing frame is assembled with the protection pad, the second recess of the packing frame is engaged with the second protuberance for localization, so as to provide an accurately positioned assembly of the packing frame, the protection pad and each of the left frame and the right frame without any location deviation.

4. The swimming goggle structure of claim 1, wherein the circular body of the protection pad is disposed with a buffer device, the buffer device comprising a plurality of compartments, the plurality of compartments having openings and being extended in an interlaced arrangement, each of the openings having a geometric shape such as including any one of a honeycomb, an ellipse and a rectangle, so as to provide a support and returning force against a structural deformation under external impact and thus to absorb a compression-fitting force under pressure.

5. The swimming goggle structure of claim 4, wherein the plurality of compartments are configured to be located at a first part of the circular body with respect to a portion of the eye socket between the eyebrow and the outer eye corner, as well as at a second part of the circular body is configured to be located with respect to a portion of the eye socket near the zygomatic bone.

6. The swimming goggle structure of claim 1, wherein the face contact circumference of the protection pad has a wavy shape, that is, the circular body has a first width sized with respect to a portion of the eye socket near the eyebrow and has a second width sized with respect to a portion of the eye socket near the zygomatic bone, wherein the first width is less than the second width, so that the protection pad is designed corresponding to the wearer's eye socket contour consisting of a raised top and a concave bottom, so as to provide a comfortable contact engagement with the wearer's eye socket.

7. The swimming goggle structure of claim 1, wherein the head strap base is disposed on the extension surface of the rim and provides an oblong hole for a head strap to get through.

8. The swimming goggle structure of claim 1, wherein a drain channel is disposed on a portion of the rim of the packing frame configured with respect to the wearer's cheek, that is, when the swimming goggles are put on, and configured to be located right below the wearer's eyeball, so as to improve drainage without water retention after the wearer leaves the water.

9. A swimming goggle structure, comprising a left frame, a right frame, a connection element, two packing frames and two head strap bases, wherein:

a left frame and a right frame, each respectively having a circumference surface, a locating flange, a circular groove and an inclined guide surface, the circumference surface being integrally formed with a lens and a connection base, the connection base being disposed on with a connection hole, the locating flange being disposed a side opposite to the lens, the circular groove abutting the locating flange, the inclined guide surface being formed at an inner edge of the circumference surface;

a connection element, engaged with the connection hole of the connection base of each of the left frame and the right frame;

two protection pads, each respectively assembled with the left frame and the right frame, each of the two protection pads having a circular body, a circular lip and a slot, a side of the circular body being arranged with a face contact circumference, the circular lip being disposed at a side opposite to the face contact circumference, the circular lip being engaged with the circular groove, the slot being disposed inside the circular body and being engaged with the locating flange; and two packing frames, each respectively assembled with the circular grooves of the left frame and the right frame, each of the packing frames having a rim, a hole and a head strap base, the rim being forced against the circular lip and being disposed with an extension surface, an internal diameter of the hole being slightly smaller than a maximum external diameter of the circumference surface of each of the left frame and the right frame, and the head strap base being disposed on the extension surface of the rim.

10. The swimming goggle structure of claim 9, wherein a first alignment device is disposed between the protection pad and each of the left frame and the right frame, and a second alignment device is disposed between the packing frame and the protection pad, the first alignment device comprising a first recess and a first protuberance, the first recess being disposed on the locating flange of each of the left frame and the right frame, the first protuberance being disposed inside the slot of the protection pad, corresponding to the first recess, and when each of the left frame and the right frame is assembled with the protection pad, the first recess of each of the left frame and the right frame is engaged with the first protuberance for localization, the second alignment device comprising a second recess and a second protuberance, the second recess being disposed on an inner edge of the hole of the packing frame, the second protuberance being disposed on the circular lip of the protection pad, corresponding to the first protuberance, and when the packing frame is assembled with the protection pad, the second recess of the packing frame is engaged with the second protuberance for localization, so as to provide an accurately positioned assembly of the packing frame, the protection pad and each of the left frame and the right frame without any location deviation.

11. The swimming goggle structure of claim 9, wherein the rim of the packing frame is disposed with an extension surface, the head strap base being disposed on the extension surface of the rim, and the head strap base providing an oblong hole for a head strap to get through.

* * * * *